US007530130B1

(12) United States Patent
Frazer

(10) Patent No.: US 7,530,130 B1
(45) Date of Patent: May 12, 2009

(54) MULTI-TOOL INCISING ATTACHMENT METHOD AND APPARATUS

(75) Inventor: Spencer Frazer, Lynnwood, WA (US)

(73) Assignee: SOG Specialty Knives, Inc., Lynnwood, WA (US)

( * ) Notice: Subject to any disclaimer, the term of this patent is extended or adjusted under 35 U.S.C. 154(b) by 123 days.

(21) Appl. No.: 11/329,316

(22) Filed: Jan. 9, 2006

(51) Int. Cl.
*B24B 7/22* (2006.01)

(52) U.S. Cl. ..... 7/129; 7/132; 7/135; 81/427.5; 81/489; 81/490

(58) Field of Classification Search ..... 7/129, 7/132, 135; 81/427.5, 489, 490
See application file for complete search history.

(56) References Cited

U.S. PATENT DOCUMENTS 5,251,353 A * 10/1993 Lin ..... 7/128
6,282,997 B1 * 9/2001 Frazer ..... 81/427.5

* cited by examiner

*Primary Examiner*—Joseph J. Hail, III
*Assistant Examiner*—Shantese L McDonald
(74) *Attorney, Agent, or Firm*—Michael F. Hughes; Hughes Law Firm, PLLC

(57) ABSTRACT

A multi-tool attachment having a configuration that is well-suited for incising material and performing various operations where two incising members are positioned on a main portion of the tool and the cutting-edge surfaces are in close engagement with one another at an interface point where the two blades meet in forceful engagement with one another.

24 Claims, 3 Drawing Sheets

MULTI-TOOL INCISING ATTACHMENT METHOD AND APPARATUS

BACKGROUND OF THE DISCLOSURE

Various instruments adapted to cut or incise material have been known in the prior art in various forms. Blades and other unitary objects are likely one of the oldest tools known to mankind and are still widely utilized in everyday life in many applications. Of course, the concept of a cutting blade is carried out in a variety of forms where a portion of the blade has a very fine surface area creating very high pressures which are adapted to incise material. With shearing scissors or the like, two blades are utilized to create a shearing highly focused pressure to cut (incise) material. It is also possible to have two adjacent fixed blades arranged in a manner to cut material such as straps or cord, for example.

In emergency situations where it is desirable to expeditiously incise material, a device such as a seat belt-like cutter is very advantageous for removal of individuals from vehicles. Of course such a tool is utilized for many different types of activities other than cutting the straps of seatbelts. However, in particular, a tool adapted to cut seat belt or other restraining device is a necessary tool for emergency response personnel. Of course such a tool can further be utilized to strip wire or any other type of cutting operation desired by the operator of the tool.

Multi-tools are well known in the art and essentially comprise a handle region and a type of pliers-like region which in many forms is a common needle nose-like pliers device, and in the broader scope can be a number of lever-like devices such as shearing members, etc. However, as described herein there are particular challenges for adapting a dual-fixed blade incising device to such a multi-tool.

In order to properly incise material with the two blades in a shearing like action, the blades in a preferred form forcefully engage one another to prevent any separation thereof. The embodiments below illustrate having the two cutting blades in forceful engagement with one another while positioned in a relatively compact manner to properly fit within the handle region of the multi-tool.

SUMMARY OF THE DISCLOSURE

As described herein there is a multi-tool attachment adapted to be positioned on a multi-tool having a handle portion comprising at least one handle and a clinching portion. The handle has longitudinal and transverse axes defined. The multi-tool attachment comprises an attachment portion having a pivot attachment that is pivotally attached to a longitudinally outward portion of the handle. There is an operating portion having a base region and an extension region. The base region has a base lateral surface and the extension region has an extension lateral surface.

Incising members are provided that comprise a base incising member having a laterally inward surface that is fixedly attached to the base region at a longitudinally inward connection portion and a longitudinally outward portion. There is also an extension incising member that has a base attachment region at a longitudinally outward connection portion and an extension attachment region at a longitudinally inward connection portion. The base region is offset from the extension region in the lateral direction where the extension lateral surface and the base lateral surface are substantially coplanar and offset the approximate lateral width distance of one of the incising members. With this arrangement the laterally inward surfaces of the base incising member and the extension incising member are in surface area engagement of the base lateral surface and the extension lateral surface at the longitudinally inward connection portions of the base incising member and the extension incising member.

The multi-tool attachment in one form has the base incising member and the extension incising member each having cutting edge surfaces that are adjacent to one another and connect at an interface point. In one form of making the attachment, the extension region and the base region are comprised of a unitary material. For definition purposes the extension region, the base region and a pivot portion are all comprised of a unitary material all comprising the main portion. The main portion defines a material open region between the pivot portion and the extension region and the material open region is positioned in the transverse direction when the multi-tool attachment is in an operating position. In one form the material open region is positioned transversely downward within the handle when the multi-tool attachment is in a closed position.

The attachment tool as described herein is shown in one embodiment having the mean lateral thickness which is the lateral width of the base region plus the lateral width of the base incising member plus the lateral width of the extension incising member. This provides a tool that is sufficiently narrow to fit in the handle of a multi-tool.

In one form the multi-tool attachment has a locking surface located at the pivot portion that is adapted to temporarily lock the multi-tool attachment in an open position. Of course this summary is not intended to narrow the attachment to any specific limitations, but rather the definitions herein are to be given their proper broad meaning as recited in the attached claims following a detailed description.

DETAILED DESCRIPTION OF THE PREFERRED EMBODIMENTS

Figure 1:
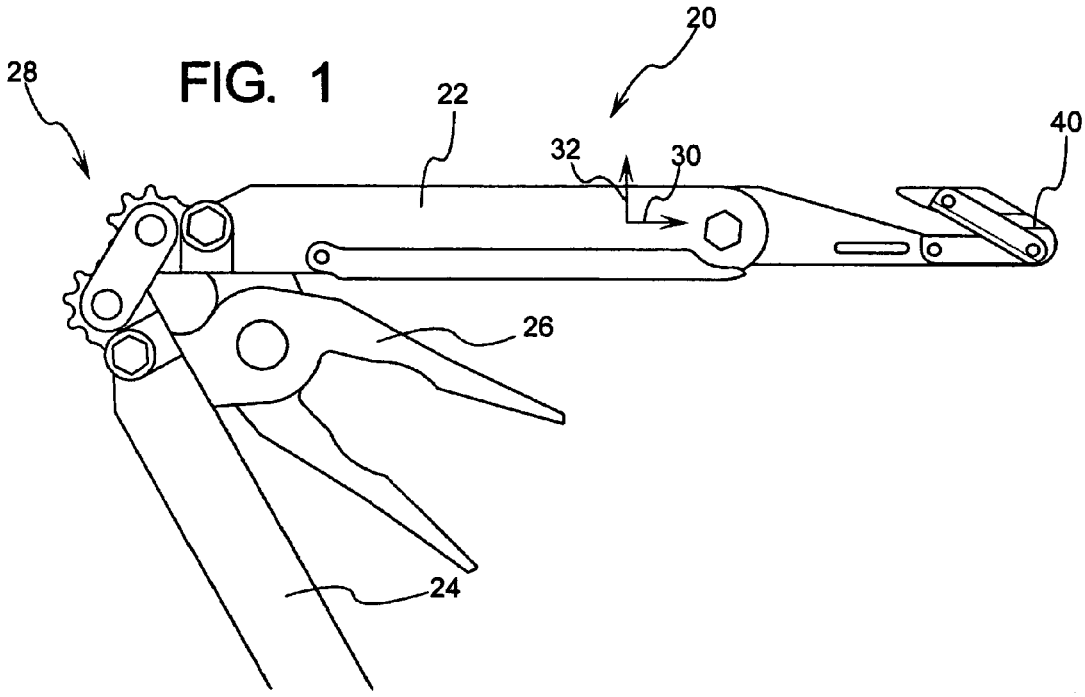
FIG. 1 shows a top view of the multi-tool with the multi-tool attachment rotatably mounted thereon.

As shown in FIG. 1, there is a multi-tool 20 which comprises handle portions 22 and 24. The multi-tool 20 further has a plier portion 26 which is adapted to cooperate with the handle portions to operate the pliers. In one form, a gear mechanism 28 can be employed but it should be noted that the multi-tool is defined broadly to cover any type of tool that has a handle region and a plier-like region which can include conventional needle nose pliers as well as any other type of gripping mechanism or shearing type mechanism. The gearing portion shown at 28 is entirely optional and this is described in U.S. Pat. No. 6,070,504 and U.S. Pat. No. 6,282,997 which are incorporated by reference.

Figure 2:
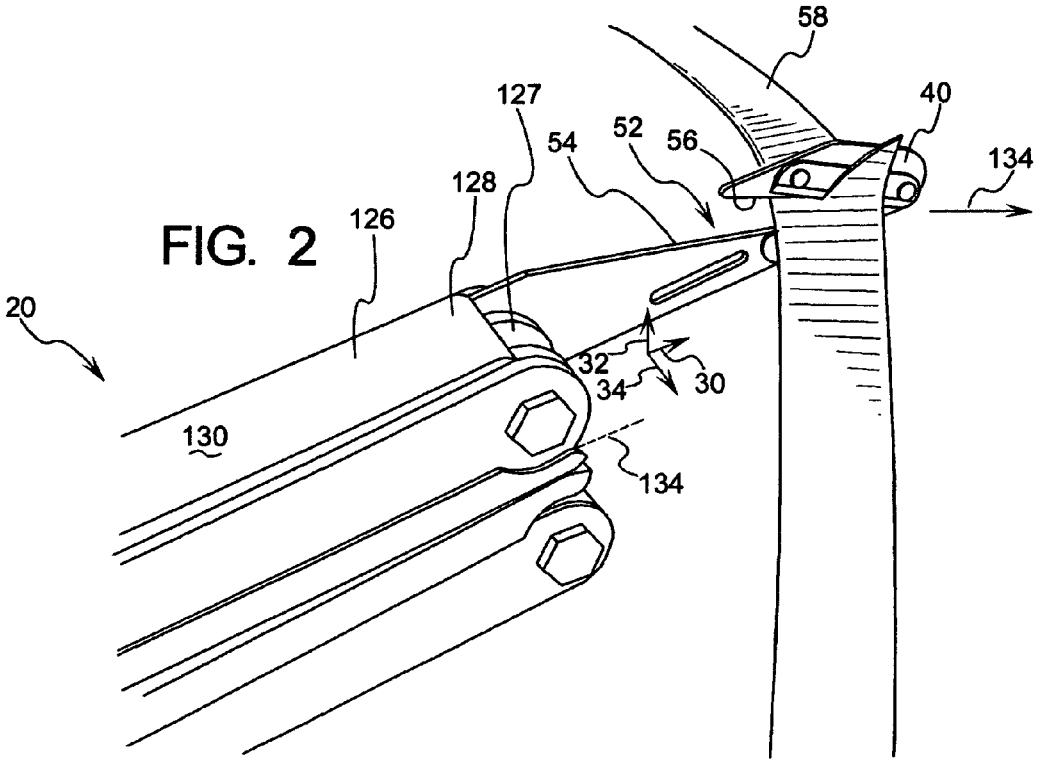
FIG. 2 discloses an isometric view where the multi-tool attachment is extracted from the handle region of the multi-tool and the attachment is incising a material.

To aid in the description, the axes system is defined with respect to the handle portion 22 where the axis 30 indicates a longitudinal axis and the axis 32 indicates a transverse axes. As shown in FIG. 2, the axis indicated at 34 indicates a lateral axis. Of course it should be noted that the various axes are provided to assist in describing the various components without necessarily limiting them to any direct orientation.

Figure 5:
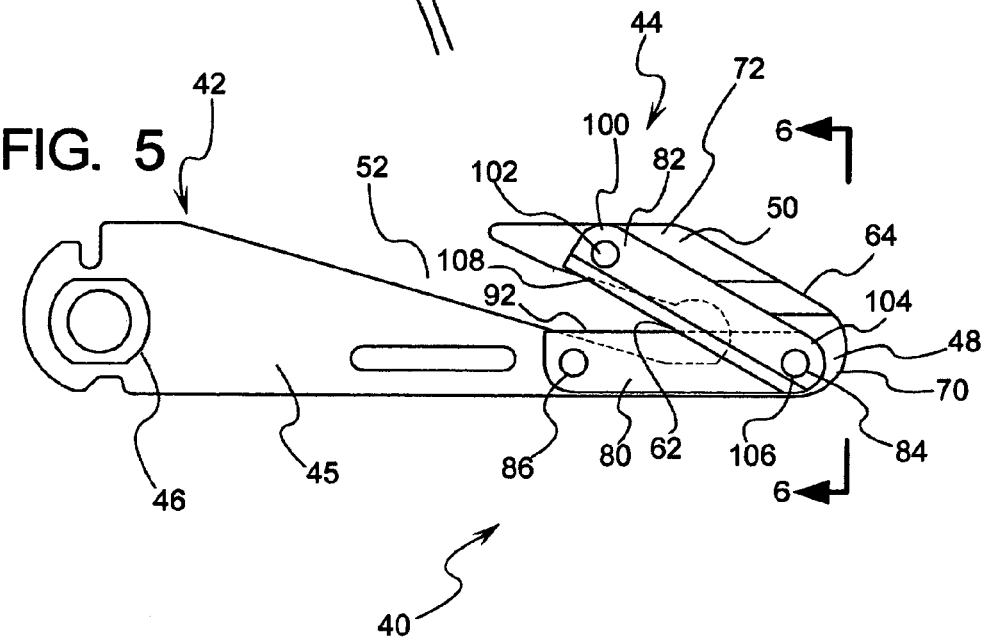
FIG. 5 shows the multi-tool attachment in a side view taken along the lateral axis.

With the foregoing description in mind, there will now be a more detailed description of a feature of the handle portion 22. Of course the feature can be applied to either portion 22 or 24, but for sake of proper description, will be shown only on one handle portion of the multi-tool 20. Referring ahead to FIG. 5, the multi-tool attachment 40 is shown where in general it comprises an attachment portion 42 and an operating portion 44.

Figure 6:
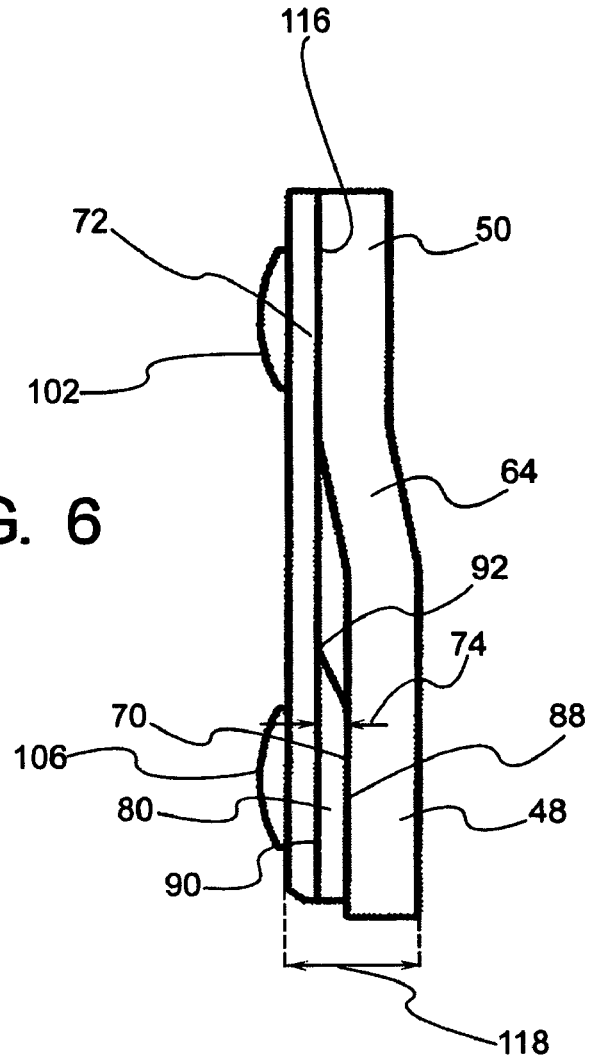
FIG. 6 shows and end view of the multi-tool attachment taken along the longitudinal axis.

As shown in FIG. 5, the multi-tool attachment 40 otherwise referred to as the incising attachment 40 comprises a main portion 45. The main portion 45 comprises the pivot portion 46, the base region 48, and an extension region 50. In one form, the main portion 45 is a unitary portion of a single piece of material, such as metal. Of course, the main portion could be comprised of separate pieces, but for ease of manufacture, a single piece of metal or other material comprises the above mentioned areas. As shown in FIG. 6, the extension region 50 is positioned laterally offset from the base region 48. The purpose of this offset is described further herein. Positioned between the extension member 50 and the pivot portion 46 is a material open region 52 (see FIGS. 5 and 7). In general, the material open region 52 is adapted to have material to be cut placed therein. The surfaces 54 and 56 are angled in a manner to properly channel a material such as 58 and shown in FIG. 2. The portion 60 on the extension region 50 is rounded so as not to snag a piece of material that is perhaps wider than the length of the interface portion 62 described below and up to the portion 60.

Referring back to FIG. 5, the lateral transition region 64 repositions the material holding the blades from the base region 48 to the extension region 50 as shown in FIG. 6. Essentially, the transition region repositions the lateral surfaces 70 and 72 in a manner so the surfaces are substantially coplanar and offset by the distance indicated at 74 which is the proximal width in the lateral direction of the base incising member 80.

Figure 7:
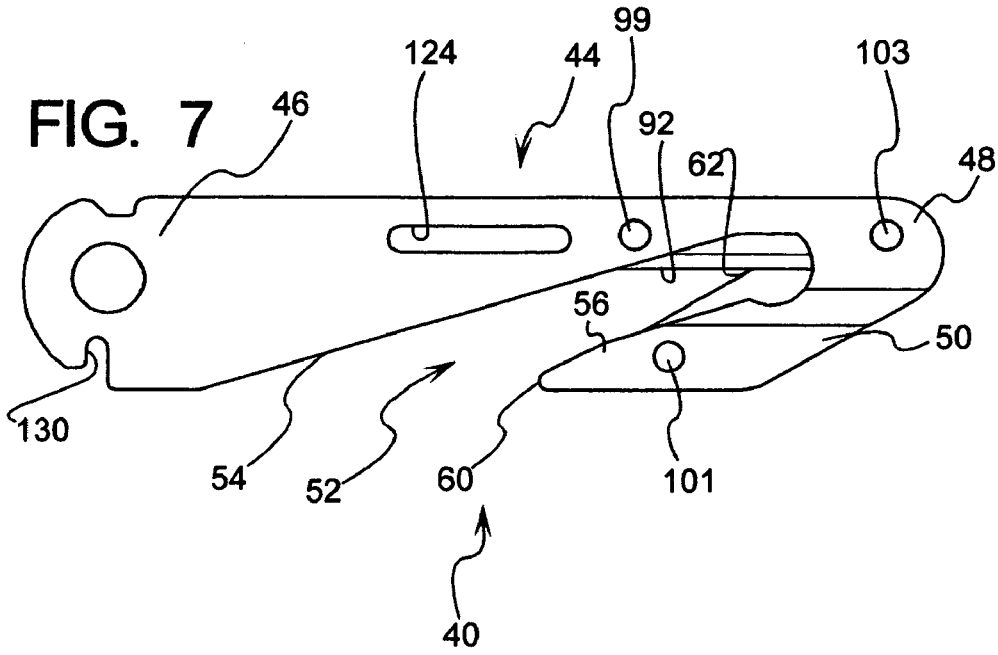
FIG. 7 shows another side view taken along the opposing lateral side of that as shown in FIG. 5.

With the foregoing description of the main operating portion 44 in place, there will now be a description of the base incising member 80 and the extension incising member 82. In general, two sharp surfaces cooperate to perform a cutting operation in a variety of manners. As shown in FIG. 5, the base incising member 80 is comprised of a longitudinally outward connection portion 84 (second end) and a longitudinally inward connection portion 86 (first end). As shown in FIG. 6, the base incising member 80 has a laterally inward surface 88 and a laterally outward surface 90. The laterally inward surface 88 is adapted to engage the base lateral surface 70, and in a preferred form, have a sufficient amount of surface contact to supply rigidity to the base incising member 80. As shown in FIG. 7, the base incising member further has an edge portion 92 that is sharpened, and as shown in FIG. 6, is slanted toward the extension incising member 82 where the edge portions 92 and 108 meet at the interface portion 62 as shown in FIGS. 5 and 7.

The extension incising member 82, as shown in FIG. 5, comprises an extension attachment region 100 with a longitudinally inward connection portion 102 (first end). The extension incising member 82 further comprises a base attachment region 104 (second end) having a longitudinally outward connection point 106. The extension incising member further comprises a sharpened edge 108 that slopes toward the base incising member such that both of the edge portions are in tight engagement at the interface point 62. The second end portions 84 and 106 for the base and extension incising members 80 and 82 in one form are connected by a single crosspin 103. The cross pins 99 and 101 at locatings 86 and 102 as shown in FIG. 7 can be constructed in a similar manner except slightly shorter in the lateral direction. This configuration provides a strong reinforcing The extension incising member 82 further has a laterally inward surface 116 that is adapted to engage the laterally outward surface (base lateral surface) 72 of the extension region 50. The mean lateral width/thickness of the unit indicated at is comprised of the lateral widths of the base region 48, the base incising member 80 and the lateral width of the extension incising member 82. This thickness 118 is sufficiently narrow (i.e. less than a ¼ of an inch) to allow the attachment 40 to be conveniently stored in the handle and have the handle accommodate other attachments under at approximately the location indicated at 127.

Of course, the multi-tool attachment 40 can be utilized in a variety of methods such as that as shown in FIG. 2 where the material 58 is desired to be cut or separated. It should be noted that the material 58 can be of a variety of types of materials which are found in the field. For example, the material 58 could be a seat belt or any cord or a type of cylindrical line. The material open region 52 is slightly slanted inwardly at the surfaces 54 and 55. This channels the material to the interface point 62 as shown in FIG. 7. As shown in FIG. 2, as the material 58 is held to resist the force exerted thereon, the leading-edge surfaces 108 and 92 cooperatively act to incise the material 58.

Figure 3:
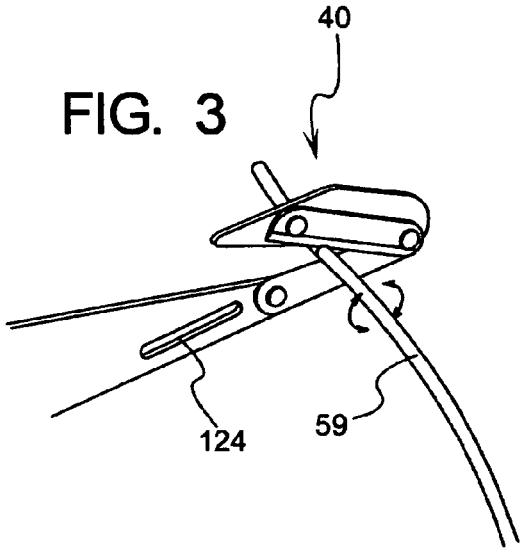
FIG. 3 shows a method of using the multi-tool attachment where the base incising member and the extension incising member cooperate to incise the portion of a material such as an insulated wire.
Figure 4:
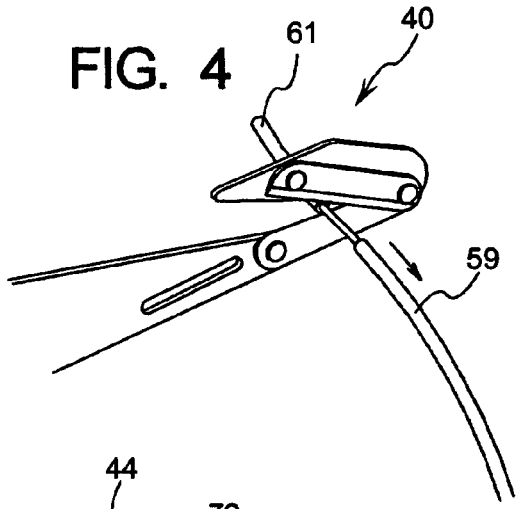
FIG. 4 shows how the incising members can separate, for example, the outer insulation of a wire from the main portion of the wire.

Now referring to FIGS. 3 and 4, it can be seen how the incising multi-tool attachment 40 can further operate to, for example, strip wire. Essentially, the wire 59 is rotated with respect to the multi-tool attachment 40 in some form where pressure is surgically applied to avoid slicing the conductive wires there underneath. As shown in FIG. 4, one of the lateral surfaces of the incising members 80 and/or 82 are adapted to press against the freshly incised surface of the portion 61. Then the wire 59 is repositioned with respect to the multi-tool attachment 40 to properly strip the wire. Of course, the tool can be utilized in a variety of other methods. It should be noted that present analysis indicates that the arrangement of the main portion and the incising members 80 and 82 has been found to create a relatively rigid structure well-suited for incising material. In particular, as shown in FIG. 6, the orientation of the surfaces 70 and 72 (herein referred to as the extension lateral surface 70 and the base lateral surface 72) can be arranged in a manner so that the interface point 62 (see FIGS. 5 and 7) is in forceful engagement between the sharpened surfaces 92 and 108. In other words, the surface 72 as shown in FIG. 6 can in one form be repositioned in the first lateral direction indicated at 120 with respect to any lateral surface 70. Essentially, this biases the extension incising members 82 toward the base incising member so there is a very tight forceful engagement at the interface point 62 as shown in FIG. 5.

Of course, the incising members 80 and 82 can be attached to the extension region 50 and the base region 40 in a variety of methods, and in one form, they can be pinned therein with an interference-type fit member such as that shown as 122 in FIG. 6. Further, an optional feature such as the surface defining the opening 124 can be utilized for cosmetic or utilitarian reasons, such as making the device lighter.

As shown in FIG. 2, a locking latch 126 is one form of locking the device open where an extension generally indicated at 128 that extends in the negative transverse direction (see axis 32) is adapted to receive the surface defining the locking notch 130 as shown in FIG. 7. Of course, a variety of locking type mechanisms can be employed. In an embodiment where the device would open from the outward portion of the handle generally indicated at 130, in a direction indicated by arrow 132, it may not be necessary to have any locking device whatsoever because the force generally exerted upon the multi-tool attachment would be in the direction indicated by vector 134 (see FIG. 2). If the maximum open position is that shown FIG. 2, then there may not be a need for any type of locking device.

It should be further noted that as shown in FIG. 2, in one form it is desirable to have the material open region 52 positioned in the positive transverse direction (see transverse axis 32 in FIG. 2), where this open region is positioned away from the center axis 134 of the multi-tool 20 when the attachment 40 is open (i.e. not stored in the handle portion). Experimentation has found that this is the desirable orientation and allows for an easier axis of the material 58 to enter into the material open region 52. Further, this also provides an easier method of opening the multi-tool attachment 40 in an emergency situation where, for example, a seat belt must be cut to extract a victim from a vehicle.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicant's general concept.

I claim:

1. A multi-tool attachment adapted to be positioned on a multi-tool having a handle portion comprising at least one handle and a clinching portion, the handle having a longitudinal and transverse axes, the multi-tool attachment comprising:

a. an attachment portion having a pivot attachment that is pivotally attached to a longitudinally outward portion of the handle, b. an operating portion having a base member and an extension member, the base member having a base lateral surface, and the extension member having an extension lateral surface, c. incising members comprising:

i. a base incising member having a laterally inward surface that is fixedly attached to the base member at a longitudinally inward connection portion and attached at a longitudinally outward portion and ii. an extension incising member having a base attachment region at a longitudinally outward connection portion and an extension attachment region at a longitudinally inward connection portion d. whereas the base member is offset from the extension member in the lateral direction where the base lateral surface and the extension lateral surface are offset the approximate lateral width distance of one of the incising members where a laterally inward surface of the base incising member is in engagement with the base lateral surface and a laterally inward surface of the extension incising member is in engagement with the extension lateral surface.

2. The multi-tool attachment as recited in claim 1 where the base incising member and the extension incising member each have cutting edge surfaces that are adjacent to one another and connect at an interface point.

3. The multi-tool attachment as recited in claim 1 where the extension member and the base member are comprised of a unitary material.

4. The multi-tool attachment as recited in claim 3 where the extension member, the base member and a pivot portion are all comprised of a unitary material all comprising a main portion.

5. The multi-tool attachment as recited in claim 4 where the main portion defines a material open member between the pivot portion and the extension member.

6. The multi-tool attachment as recited in claim 5 where the material open region is positioned in the transverse direction when the multi-tool attachment is in an operating position.

7. The multi-tool attachment as recited in claim 6 where the material open region is positioned transversely downward within the handle when the multi-tool attachment is in a closed position.

8. The multi-tool attachment as recited in claim 1 where a mean lateral thickness of the multi-tool attachment is the lateral width of the base member plus the lateral width of the base incising member plus the lateral width of the extension incising member and the mean lateral thickness is sufficiently narrow to allow other attachments be positioned in the handle portion.

9. The multi-tool attachment as recited in claim 1 where located at the pivot portion is a locking surface adapted to temporarily lock the multi-tool attachment in an open position.

10. A multi-tool having a handle and a clenching portion, whereby positioned on the handle away from the clenching portion is an incising attachment pivotally attached thereto, the incising attachment comprising a base member and an extension member defining an open region therein between and the base member and an extension member each having lateral surfaces that are not in the same plane, a base incising member having a longitudinally inward portion and a longitudinally outward portion and having a laterally inward surface adapted to engage the lateral surface of the base member, the base incising member further having a edge surface position toward the open member, an extension incising member having a portion attached to the lateral surface of the extension member and another portion attached to a laterally outward area of the incising attachment adjacent to the longitudinally outward portion of the base incising member, the extension incising member having an edge surface that is adapted to be positioned adjacent to the edge surface of the base incising member and forcefully engaged thereto.

11. The multi-tool as described in claim 10 where the open region is positioned transversely outwardly from the center axis of the multi-tool when the incising attachment is in an open position.

12. The multi-tool as described in claim 10 where the incising attachment has a locking notch that is adapted to lock the incising attachment in an open position.

13. The multi-tool as recited in claim 10 where the extension member has a rounded portion and a longitudinally inward region that is adapted to not get caught on material to be cut by the incising attachment.

14. The multi-tool as described in claim 10 where the main lateral width of the multi-tool is the lateral width of the sum of the lateral widths of the base member, the base incising member and the extension incising member.

15. The multi-tool as described in claim 14 where the main lateral width of the incising member occupies less than one half of an available space defined by a surface in the handle of the multi-tool.

16. A method of cutting material comprising retrieving a multi-tool and pivotally extracting a cutting element therefrom, positioning the material between an extension member and base member of the cutting attachment where a base incising member and an extension incising member are fixedly and non-rotatably attached with respect to one another and edge portions of the base incising member and the extension incising member are in lateral proximal engagement to one another where a material open member which provides an opening for the material to be cut to be positioned adjacent to the base incising member and the extension incising member is positioned outwardly from the central axis of the multi-tool and the main lateral width of the multi-tool is sufficiently narrow that other utensils can be positioned in the handle region of the multi-tool.

17. The method of cutting material as recited in claim 16 where the cutting attachment is adapted to be locked in an open position.

18. The method of cutting material as recited in claim 17 where the cutting attachment can be extracted while a crimping portion of the multi-tool is in a stored position.

19. The method of cutting material as recited in claim 16 where the material open region is positioned outwardly from a center axis of the multi-tool when the cutting attachment is in an open position.

20. The method of cutting material as recited in claim 16 where a mean lateral thickness of the attachment is sufficiently narrow to allow other attachments to coincide in the handle portion.

21. A cutter attachment adapted to be attached to a multitool in the handle portion, the cutter attachment comprising:

a. a base structure having a connection portion pivotally connected to the handle portion, the structure comprising a base member and an extension member, b. a base incising member having first and second ends attached to the base member, c. an extension incising member having a first end attached to the extension member and a second end attached at the same proximal location of the second end of the base incising member, d. whereas the cutter attachment is constructed where the first and second ends of the base incising member are rigidly attached to the base member and the first end of the extension incising member is rigidly attached to the extension member and the second end is rigidly attached to the base member whereby the structural integrity of the base structure is greater with the base incising member and the extension incising member attached thereto and the lateral width of the cutter attachment is such that it is adapted to fit in the handle portion of the multitool.

22. The cutter attachment as recited in claim 21 where the first and second attachment regions of the base incising member and the first and second attachment regions of the extension incising member are all pinned to the base structure.

23. The cutter attachment as recited in claim 22 where a single pin operates as a connection member for both of the second ends of the base incising member and the extension incising member.

24. The cutter attachment as recited in claim 21 where the thickness of the cutter attachment is less than ¼ of an inch.

* * * * *